US007594466B2

(12) United States Patent
Guay et al.

(10) Patent No.: US 7,594,466 B2
(45) Date of Patent: Sep. 29, 2009

(54) ACTUATOR WITH A PROTECTIVE SLEEVE FOR A PISTON

(75) Inventors: Suzie Guay, Sainte-Justine (CA); Renaud Bourdon, Lac-Etchemin (CA); Simon Desbiens, Lac-Etchemin (CA); André Bilodeau, Lac-Etchemin (CA); Dany Lapointe, Sainte-Justine (CA)

(73) Assignee: Rotobec Inc., Quebec (CA)

( * ) Notice: Subject to any disclaimer, the term of this patent is extended or adjusted under 35 U.S.C. 154(b) by 199 days.

(21) Appl. No.: 11/653,087

(22) Filed: Jan. 12, 2007

(65) Prior Publication Data

US 2008/0168897 A1 Jul. 17, 2008

(51) Int. Cl.
*F15B 15/20* (2006.01)
*E02F 9/24* (2006.01)

(52) U.S. Cl. ..... 92/110; 92/117 R; 92/53

(58) Field of Classification Search ..... 92/51, 92/52, 117 A, 117 R
See application file for complete search history.

(56) References Cited

U.S. PATENT DOCUMENTS

| | | | | |
|---|---|---|---|---|
| 2,470,540 | A | 5/1949 | Young | |
| 2,804,050 | A | 9/1957 | Spilling | |
| 3,019,663 | A | 2/1962 | Breunich | |
| RE27,183 | E * | 10/1971 | Rosaen | 92/117 R |
| 3,870,287 | A | 3/1975 | McMahon | |
| 4,260,177 | A | 4/1981 | Pflughaupt | |
| 4,384,817 | A | 5/1983 | Peterson | |
| 4,813,913 | A | 3/1989 | Belter | |
| 4,930,403 | A | 6/1990 | Husted | |
| 4,936,193 | A | 6/1990 | Stoll | |
| 5,152,351 | A * | 10/1992 | Rieger | 92/53 |
| 5,386,652 | A * | 2/1995 | Ramun | 37/406 |
| 5,533,596 | A | 7/1996 | Patzenhauer | |
| 5,964,140 | A | 10/1999 | Guenther | |
| 6,038,959 | A * | 3/2000 | Sawada | 92/107 |
| 6,112,439 | A | 9/2000 | Rinker | |
| 6,460,665 | B1 | 10/2002 | Gotz | |
| 6,758,467 | B2 | 7/2004 | Kitaura | |
| 6,843,005 | B2 * | 1/2005 | Clapper | 37/406 |
| 6,874,338 | B1 | 4/2005 | Hunt | |
| 2001/0018863 | A1 | 9/2001 | Heinz | |

FOREIGN PATENT DOCUMENTS

| | | |
|---|---|---|
| CA | 1 176 915 | 10/1984 |
| DE | 3836898 | 5/1990 |
| EP | 48362 | 3/1982 |

* cited by examiner

*Primary Examiner*—Thomas E Lazo
(74) *Attorney, Agent, or Firm*—Knobbe Martens Olson & Bear LLP

(57) ABSTRACT

The invention relates to an actuator for heavy machinery including a cylinder, a piston and a protective sleeve. The cylinder forms a chamber for receiving a fluid, and includes an external flange extending radially and outwardly from the cylinder. The piston is operable to translate axially relative to the cylinder between an open position and a closed position, and includes a first extremity positioned outside the cylinder and a second extremity positioned within the chamber. The second extremity sealingly engages the chamber. The protective sleeve protects the piston in the open position, which is movable with the piston and operable to overlap at least a portion of the cylinder in the closed position. The protective sleeve includes an internal flange extending radially and inwardly from the protective sleeve and is positioned for abutting the external flange when the piston is in the open position. This abutment limits the axial translation of the piston out of the cylinder.

9 Claims, 3 Drawing Sheets

ACTUATOR WITH A PROTECTIVE SLEEVE FOR A PISTON

FIELD OF THE INVENTION

The present invention relates generally to the field of hydraulic or pneumatic actuators. More specifically, it concerns a protective sleeve for hydraulic or pneumatic actuator.

BACKGROUND OF THE INVENTION

Hydraulic and pneumatic actuators are well known in the art. Indeed, a conventional hydraulic or pneumatic actuator normally consists of a hollow cylinder and a piston able to fit sealingly therein and adapted to translate relative to the cylinder in an axial direction between an open position and a closed position. The piston sealingly engages the inner surface of the cylinder so as to create a chamber whose volume varies with the position of the piston. A pressurized fluid can be supplied to, or withdrawn from, the chamber in order to force and change in the chamber's volume and thereby change the position of the piston relative to the cylinder.

A common use for such an actuator is as a hydraulic actuator for heavy machinery, such as a grapple, an excavator or the like. Such heavy machinery run large gasoline or diesel powered engines to power hydraulic pumps, which in turn pressurise hydraulic fluid. This machinery often comprises large mechanical arms, or booms, driven by externally mounted hydraulic actuators. When the actuator is extended, the piston is exposed to an environment where it is vulnerable to damage which could compromise the functioning of the hydraulic actuator. In addition, the piston may simply become dirty as unwanted contaminants, metallic dust particles for example, are deposited on the surface of the piston. Repeated contraction and expansion of the actuator can cause these contaminants to enter into the chamber thereby damaging the piston seal and the inner surface of the cylinder. Both such aspects of exposure have a detrimental effect on the functioning of the actuator and can lead to actuator failure.

The following U.S. and Canadian patents disclose prior art devices for protecting actuator pistons.

U.S. Pat. No. 4,936,193, issued Jun. 26, 1990 to STOLL, describes a protective device comprising a series of cylindrical guard sections operable to protect a piston rod when in an open position. The first of the series of guard sections is fixed to the extremity of the cylinder from which protrudes the piston rod, and the last of the series is fixed to the outer extremity of the piston rod itself. The sections decrease in diameter in a telescopic manner, such that they may be stowed in an overlapping arrangement, one inside another, in a closed position and extended together in an open position. Each guard section comprises an inwardly extending flange at its outer extremity and an outwardly extending flange at its inner extremity. In use, the inwardly extending flange engages the outwardly extending flange of the next guard so as to prevent the complete drawing apart of the individual guard sections in the open position. However, this design is relatively complex comprising a number of sliding elements and engagements.

U.S. Pat. No. 5,386,652 issued to RAMUN, U.S. Pat. No. 6,843,005 issued to CLAPPER, U.S. Pat. No. 5,152,351 issued to RIEGER and Canadian patent No. 1,176,915 issued to MARTIN all disclose actuator protection devices for heavy machinery wherein a piston protector is attached to an outside extremity of a piston rod and is operable to cover at least portion of the exposed piston rod when the cylinder is in an open position.

However, while each of these devices may aid in protecting a piston rod in an exposed open position, there is still a continued need for an improved actuator for heavy machinery that overcomes at least some of the above-mentioned disadvantages.

SUMMARY OF THE INVENTION

It is an object of the present invention to provide an improved actuator for heavy machinery.

According to a first aspect, that object is achieved with an actuator for heavy machinery including a cylinder, a piston and a protective sleeve. The cylinder forms a chamber for receiving a fluid, and includes an external flange extending radially and outwardly from the cylinder. The piston is operable to translate axially relative to the cylinder between an open position and a closed position, and includes a first extremity positioned outside the cylinder and a second extremity positioned within the chamber. The second extremity sealingly engages the chamber. The protective sleeve is movable with the piston and protects the same in the open position. The protective sleeve is also operable to overlap at least a portion of the cylinder in the closed position. The protective sleeve further includes an internal flange extending radially and inwardly from the protective sleeve. The internal flange is positioned for abutting the external flange when the piston is in the open position. This abutment limits the axial translation of the piston out of the cylinder.

As can be appreciated, the protective sleeve of the present design not only protects the piston cylinder when exposed, but it also advantageously provides a simple and relatively inexpensive construction which allows a limitation of the translation of the piston out of the cylinder. Indeed, thanks to the internal flange which cooperates with the external flange on the cylinder, the piston is prevented from falling out of the cylinder. This additional functionality advantageously simplifies the overall design of the hydraulic actuator and provides additional structural integrity and operability.

For the sake of clarity of the following description, it is worth mentioning that as discussed herein the expansion and contraction of the actuator will be described from the frame of reference of a fixed cylinder wherein the actuator expands in a forward direction and retracts in a rearward direction. In addition, as used herein the open position refers to the most forward position or expanded position of the piston where the volume of the chamber is at its maximum, and similarly the closed position refers to the most rearward position or retracted position of the piston where the chamber of the cylinder is at its minimum. Also for a sake of clarity, the first and second extremities of the piston and cylinder, will be referred to as the front and rear extremities respectively.

In accordance with a first preferred variant, the piston comprises an engagement portion at the front extremity for engagement with a driven article, the protective sleeve having a first end attached to the engagement portion. The first end will also be referred to as the front end.

Preferably, the engagement portion comprises a fixture for receiving a pin connection, and the protective sleeve comprises an axial flange extending from the front end, the axial flange engaging the fixture, thereby retaining the protective sleeve to the piston.

In accordance with another preferred variant, the protective sleeve comprises a first end wall extending radially at the first end thereof, the first end wall comprising a first aperture for receipt of the piston. More preferably, the protective sleeve comprises a second end wall extending radially at a second end of the sleeve, the second end wall having an aperture for passage of the cylinder. The second end, the first and second end walls, the first and second apertures will similarly be referred to as the rear end, the front and rear end walls, and the front and rear apertures, respectively.

BRIEF DESCRIPTION OF THE DRAWINGS

These and other objects and advantages of the invention will become apparent upon reading the following description and upon referring to the drawings in which.

Figure 1A:
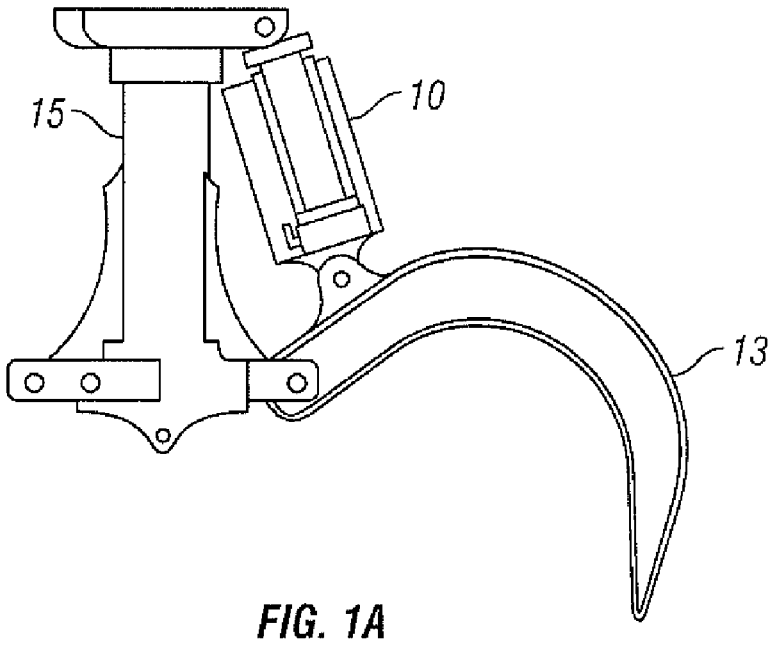
FIGS. 1A and 1B are side views of a portion of a grapple provided with an actuator according to a preferred embodiment of the present invention, the actuator being shown in a closed position in FIG. 1A and in an open position in FIG. 1B.

While the invention will be described in conjunction with an example embodiment, it will be understood that this is not intended to limit the scope of the invention to such an embodiment. On the contrary, it is intended to cover all alternatives, modifications and equivalents as may be included as defined in the appended claims.

DETAILED DESCRIPTION OF A PREFERRED EMBODIMENT

In the following description, similar features in the drawings are given similar reference numerals, and in order to lighten the figures, some elements may not be referred to in some figures if they were already identified in a precedent figure.

Figure 1B:
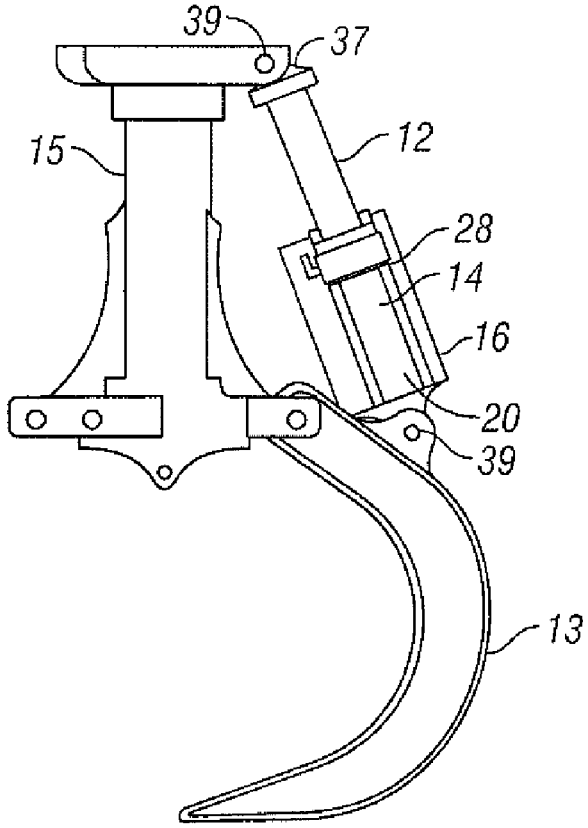

Referring to FIGS. 1A and 1B, there is shown generally a portion of a grapple for handling scrap and the like. The grapple has a shaft 15 and a plurality of grapple tines 13 pivotally fixed to the end of the shaft 15, although for clarity only one tine 13 is shown here. By means of the actuator 10 which interconnects the grapple tine 13 to the shaft 15, the grapple tine 13 can be pivoted between a retracted position, as seen in FIG. 1A, and a gripping position, as seen in FIG. 1B. As is common, pressurised hydraulic fluid is supplied to the actuator 10 in order to drive its expansion and contraction.

As will be apparent to one of ordinary skill in the art, such an actuator 10 can be provided to actuate many other hydraulically or pneumatically driven components associated with heavy machinery, such as grapple tines 13 and the like. Such equally suitable applications will therefore not be discussed further herein.

Figure 2:
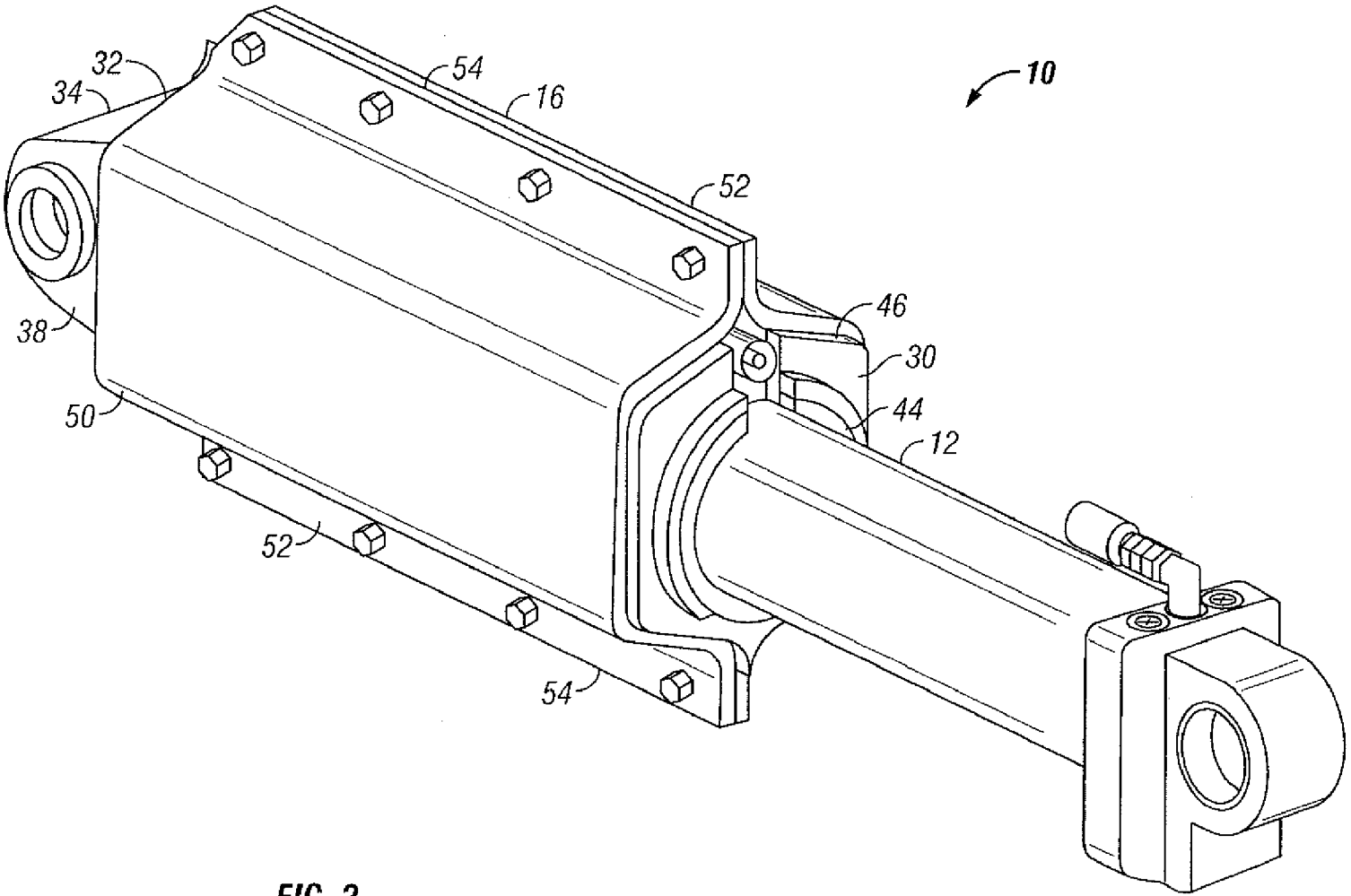
FIG. 2 is a perspective view of the actuator of the previous Figures in an open position.
Figure 3:
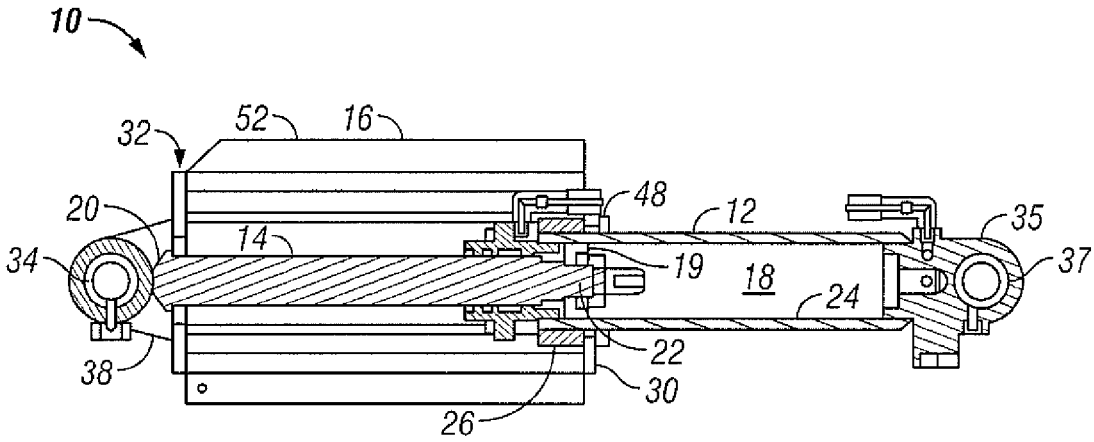
FIG. 3 is a cross-sectional side view of the actuator shown in FIG. 2.

Referring now to FIGS. 2 to 5, the actuator 10 according to a preferred embodiment of the invention comprises a cylinder 12, a piston 14 and a protective sleeve 16. The piston 14 and sleeve 16 are operable to slide axially in unison with respect to the cylinder 12 between the open position, as seen in FIGS. 1B, 2 and 3, and the closed position, as seen in FIG. 1A. The hollow interior of cylinder 12 receives the piston 14 for forming an inner chamber 18. In operation, the actuator 10 extends and contracts as fluid is either supplied or removed therefrom.

The piston 14 has a front extremity 20 which extends outside of the cylinder 12 through an entry end 28 of the cylinder 12, and a rear extremity 22 located within the chamber 18 which sealingly engages the inner surface 24 of the cylinder 12 at a sealing engagement 19. At the front extremity 20 is an engaging portion 34 adapted for engagement with a driven article such as a tine 13 of the grapple shown in FIGS. 1A and 1*b*. A rear engaging portion 35 is also provided at the rear end 37 of the cylinder 12 in order to connect the actuator 10 to a corresponding component of a grapple such as the shaft 15 in FIGS. 1A and 1B. In the preferred embodiment illustrated, both engagement portions 34 and 35 are provided with a hole 36 for pivotally connecting the driven article to the piston 14, or the cylinder 12 to the shaft 15, by means of a pivot rod 39.

The axial position of the piston 14 with respect to the cylinder 12 is defined by the closed volume of the chamber 18. In use, hydraulic fluid is fed into the chamber 18 thereby expanding it and forcing the piston 14 outwards. Alternatively, hydraulic fluid may be removed from the chamber 18 thereby decreasing its volume and forcing the piston 14 inwards.

In addition, and as will be apparent to one of ordinary skill in the art, a secondary chamber may further be provided within the cylinder 12 located on the opposite side of the sealing engagement 19 to the chamber 18. Formed within the cylinder 12, around the piston 14 and between the engagement 19 and the entry end 28, such a secondary chamber can be used in conjunction with the chamber 18 to axially translate the piston 14. As is well known in the art and will not be discussed further herein, a pair of opposed chambers work together by feeding fluid into one, while removing fluid from the other, and vice versa in order displace the piston by the application of both positive and negative pressure in both directions of motion.

Figure 5:
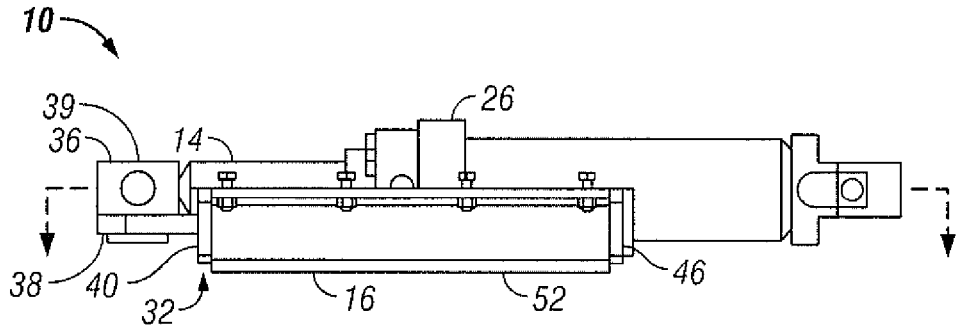
FIG. 5 is a bottom view of the actuator shown in FIG. 4.

The protective sleeve 16 is provided for protecting the exterior surface of the piston 14 from any unwanted and potentially damaging debris or impact. The protective sleeve 16 comprises opposite front and rear ends 32 and 46, the front end 32 being proximate the front extremity 20 of the piston 14. An axial flange 38 extends axially outward from the front end 32 and attaches to the engaging portion 34 of the piston 14. This attachment is firm and enables the sleeve 16 to follow the motion of the piston 14, in other words to move in synchronism with the piston 14. With the specific reference to FIG. 5 illustrating the actuator 10 with half of the protective sleeve 16 removed, the protective sleeve 16 preferably comprises a first axially extending flange 38 as shown and an equivalent second flange 38 extending axially from the removed half of the sleeve 18. Combined, the pair of axially extending flanges 38 are operable to sandwich the engaging portion 34 of the piston 14.

Figure 4:
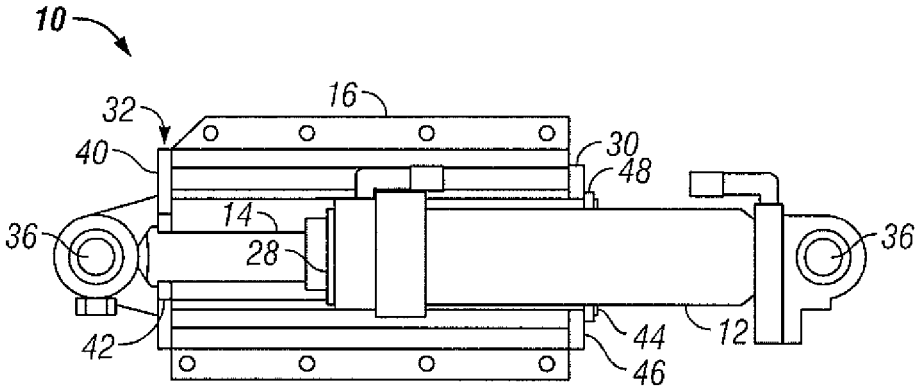
FIG. 4 is a side view of the actuator of FIG. 2 in a semi-open position, and with one half of the protective sleeve not illustrated.

In the closed position, the protective sleeve 16 overlaps at least a portion of the cylinder 12, preferably the whole length of the cylinder 12, as shown in FIG. 1A. The piston 14 and the cylinder 12 are preferably substantially the same length such that the travel of the piston 14 may be maximized. Preferably, the protective sleeve 16 is operable to cover the entirety of the outer surface of the piston 14 when in the open position, as shown in FIGS. 1B and 3. However, it is to be noted that other arrangements whereby the protective sleeve 16 covers only a portion of the cylinder 12 are well within the scope of the invention. The protective sleeve 16 is of a larger diameter than the cylinder 12 such that it may envelop the cylinder 12 in, for example, a semi-contracted position as seen in FIGS. 4 and 5.

Further provided on the cylinder 12 is an external flange 26 extending radially and outwardly from the cylinder 12. Preferably, the external flange 26 is located proximate the entry end 28 of the cylinder 12. The protective sleeve 16 further comprises a corresponding internal flange 30 extending radially and inwardly and that is positioned for abutting the external flange 26 of the cylinder 12 when the piston 14 is in the open position. Preferably, the internal flange 30 is located at the rear end 46 of the protective sleeve 16. This abutment of the external and internal flanges 26 and 30 creates a mechanical stop limiting the axial translation of the piston 14 out of the cylinder 12. Preferably, the external flange 26 of the cylinder 12 is a collar surrounding the majority of the circumference of the cylinder 12, although it will be noted that other embodiments are well within the scope of the present invention.

While the surface of the protective sleeve 16 protects the piston 14 from a direct impact, the exterior surface of the piston 14 cannot be entirely sealed from airborne debris and contaminants. A front end wall 40 is provided at the front end 32 of the protective sleeve 16 for shielding the interior of the protective sleeve 16 against the entry of such debris and contaminants. The front end wall 40 comprises an aperture 42 through which the piston 14 passes. In the preferred embodiment illustrated, the internal flange 30 also functions as a rear end wall in that it not only abuts the external flange 26 but it also functions to block the entry of a majority of the airborne debris and contaminants. Preferably, the external flange 36 further comprises a collar 44 having an aperture 48 for closely surrounding the sleeve 16 and allowing it to pass around the cylinder 12 as the sleeve 16 translates between the open and closed positions.

Because the front and rear end wall 40 and the collar 44 are provided primarily for limiting the entry of potentially damaging airborne particles, they do not need to be built as robustly as the external and internal flanges 26 and 30 which provide mechanical stopping for the actuator 10.

The dimension of the rear aperture 48 of the sleeve 16 is necessarily larger than the outer diameter of the cylinder 12 so that the sleeve 16 may move without unwanted contact and frictional interference between the rear end wall 44 and the outer surface of the cylinder 12 during expansion and contraction of the actuator 10. The dimension of the rear aperture 48 is therefore preferably as close to the diameter of the cylinder 12 as possible so as to minimise the entry of debris and contaminants inside the protective sleeve 16, while allowing the sleeve 16 and the cylinder 12 to move freely.

The protective sleeve 16 is preferably formed of two formed pieces of sheet metal 52 attached together at flanges 54, on opposite sides of the apparatus 10.

As being now better appreciated, the present invention is an improvement and presents several advantages over other related devices known in the prior art. Indeed, the present invention is particularly advantageous in that it provides a protective sleeve 16 operable to both protect the exposed piston 14 from damage and contamination when the actuator 10 is in an open position, and it limits the travel of the piston 14 within the cylinder 12. This advantageous second operability removes the necessity of a mechanical stop within the cylinder 12 as in conventional actuators by placing it outside the cylinder over a larger area, thereby enhancing the structural integrity and simplifying the construction of the actuator 10. Such simplifying in turn lowers the cost of production and increases the durability and robustness of the actuator 10.

The above description of a preferred embodiment of the present invention should not be read in a limitative manner as refinements and variations are possible without departing from the spirit of the invention. The scope of the invention is defined in the appended claims and their equivalents.

The invention claimed is:

1. An actuator for heavy machinery comprising:

a) a cylinder forming a chamber for receiving a fluid, the cylinder comprising an external flange extending radially and outwardly from the cylinder;

b) a piston operable to translate axially relative to the cylinder between an open position and a closed position, the piston comprising a first extremity positioned outside the cylinder and a second extremity positioned within the chamber, the second extremity sealingly engaging the chamber; and c) an unsealed protective sleeve for protecting the piston in the open position, the protective sleeve being movable with the piston and operable to overlap at least a portion of the cylinder in the closed position, the protective sleeve comprising an internal flange extending radially and inwardly from the protective sleeve, positioned for abutting the external flange when the piston is in the open position, and thereby limiting the axial translation of the piston out of the cylinder.

2. The actuator of claim 1, wherein the piston comprises an engagement portion at the first extremity for engagement with a driven article, the protective sleeve having a first end attached to the engagement portion.

3. The actuator of claim 2, wherein the engagement portion is provided with a hole for receiving a pin connection.

4. The actuator of claim 3, wherein the protective sleeve comprises an axial flange extending from the first end, the axial flange being secured to the engagement portion of the piston, thereby retaining the protective sleeve to the piston.

5. The actuator of claim 4, wherein the protective sleeve comprises a first end wall extending radially at the first end thereof, the first end wall comprising a first aperture for receipt of the piston.

6. The actuator of claim 5, wherein the protective sleeve comprises a second end wall extending radially at a second end of the sleeve, the second end wall having a second aperture for passage of the cylinder.

7. The actuator of claim 6, wherein the internal flange is bordering the second aperture.

8. The actuator of claim 6, wherein the protective sleeve is formed of two formed sheet metal elements attached to each other.

9. The actuator of claim 1, wherein the external flange consists of a collar provided at the entry end of the cylinder.

* * * * *